United States Patent [19]

Fukumochi et al.

[11] Patent Number: 4,919,424

[45] Date of Patent: Apr. 24, 1990

[54] GOLF PUTTER

[76] Inventors: Keisuke Fukumochi; Etsuko Fukumochi; Nobumoto Fukumochi; Naotoshi Fukumochi; Kazumasa Fukumochi, all of 1-54, Sakuramachi, Nishinomiya, Japan

[21] Appl. No.: 187,646

[22] Filed: Apr. 28, 1988

[30] Foreign Application Priority Data

May 6, 1987 [JP] Japan ..... 62-68103[U]

[51] Int. Cl.[5] ..... A63B 53/02

[52] U.S. Cl. ..... 273/164; 273/183 D

[58] Field of Search ..... 273/164, 164 A, 167 D, 273/167 F, 167 G, 183 D, 163 R, 163 A, 80.1, 80.2, 80.3, 80.4, 80.5, 80.6, 80.7, 80.8, 80.9, 80 C; D21/214–220

[56] References Cited

U.S. PATENT DOCUMENTS

D. 239,637 4/1976 Loggins ..... 273/164
1,327,171 1/1920 Ruggles ..... 273/163 R
4,367,877 1/1983 Gibson et al. ..... 273/164
4,519,612 5/1985 Tsao ..... 273/163 R
4,629,193 12/1986 Pierman ..... 273/183 D

*Primary Examiner*—Edward M. Coven
*Assistant Examiner*—Valerie Szczepanik

[57] ABSTRACT

An improved golf putter having a head formed by a vertical wall and a horizontal base, an inclined bar extending rearwardly at an angle from the top end of the vertical wall, a shaft mounting bar extending horizontally from the upper end of the inclined bar toward one end of the vertical wall, and a shaft mounted on the other end of the shaft mounting bar. The putter is swung with the inclined bar aligned with the direction of the hole. The shaft and the shaft mounting bar do not hinder the view of the inclined bar. A mirror is attachable to an upper surface of the inclined bar. Given the clear view of the inclined bar with the mirror thereon, a golfer easily sights the hole while looking down, realigns the putter if necessary, and is able to swing the putter in the proper direction.

3 Claims, 2 Drawing Sheets

GOLF PUTTER

BACKGROUND OF THE INVENTION

The present invention relates to a golf putter.

Golf putters are available in various shapes and constructions, but no putter is available that allows a golfer to grasp accurately the direction of the hole from the putting point for accurate putting.

SUMMARY OF THE INVENTION

It is an object of the present invention to provide a golf putter which allows a golfer to estimate before putting in which direction the ball will roll and which thus allows accurate putting.

In accordance with the present invention, there is provided a golf putter comprising: a head having a vertical wall and a base projecting rearwardly from the back of the vertical wall at lower end thereof, the front surface of the vertical wall serving as a putting surface and the head being of a substantially L-shaped section; an inclined bar extending from the top center of the vertical wall rearwardly, upwardly and obliquely so as to be perpendicular to the vertical wall when viewed from top; a shaft mounting bar extending horizontally from the upper end of the inclined bar toward one end of the vertical wall; and a shaft mounted to the other end of the shaft mounting bar so as to extend vertically.

The putter is held by the grip of the shaft fixed to the shaft mounting bar and swung to putt the ball at the front face of its head. Before taking a swing, the angle and direction of the putter head can be adjusted with respect to the hole by orienting the inclined bar toward the hole. Then the putter is swung in the direction of the axis of the inclined bar.

Thus, the inclined bar extending upwardly and rearwardly from the upper surface of the head at its center allows a golfer to know in which way the putter head is oriented and thus allows exact putting both directionwise and distancewise.

Other features and objects of the present invention will become apparent from the following description taken with reference to the accompanying drawings, in which:

DETAILED DESCRIPTION OF THE PREFERRED EMBODIMENT

Figure 1:
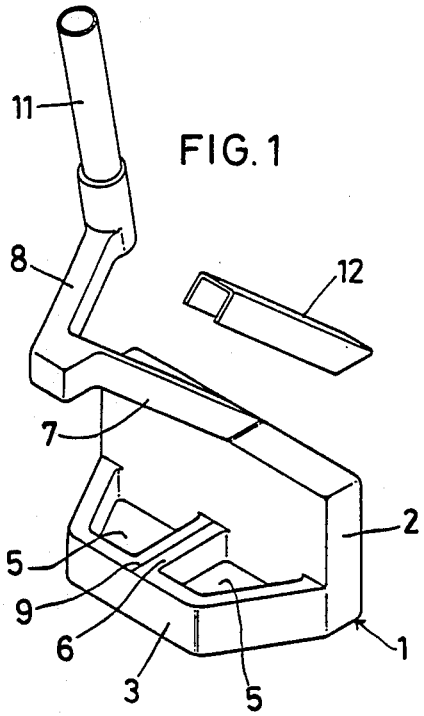
FIG. 1 is an exploded perspective view of the putter according to the present invention.

Now referring to the drawings, the head 1 of the putter according to the present invention comprises a vertical wall 2 substantially as high as the diameter of a golf ball A and a base or projection 3 provided on the back of the wall 2 at its lower end so as to extend rearwardly. Thus, the head 1 has a substantially L-shaped vertical section as will be seen in FIG. 2. The front face of the vertical wall 2 serves as a putting surface 4. The base 3 is formed in its top surface with a pair of recesses 5 and an axial center rib 6 therebetween.

There is provided an inclined bar 7 extending upwardly obliquely and rearwardly from the top center of the vertical wall 2 of the head 1 so as to be perpendicular to said vertical wall as viewed from top.

The top end of the inclined bar 7 connects to a shaft mounting bar 8 extending horizontally and obliquely toward one end of the vertical wall 2. A shaft 11 of the putter is secured to the other end of the shaft mounting bar 8.

Figure 2:
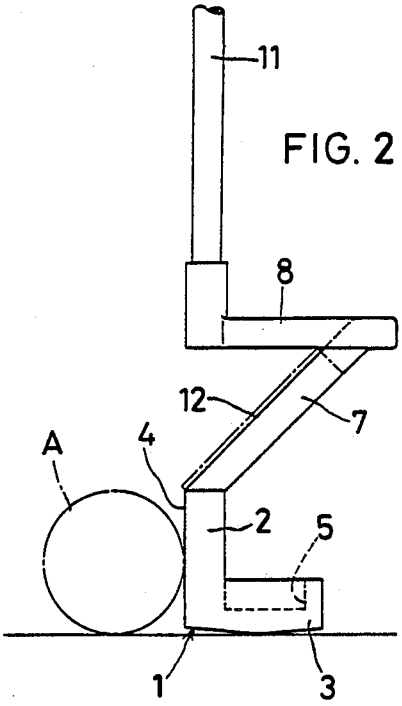
FIG. 2 is a side view of the same.
Figure 3:
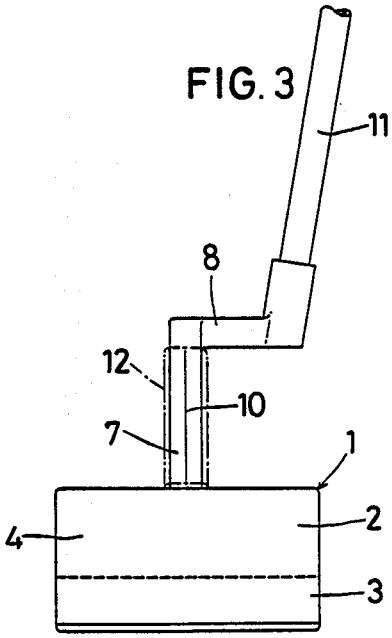
FIG. 3 is a front view of the same.
Figure 4:
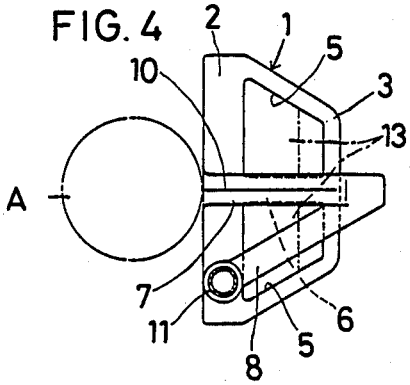
FIG. 4 is a plan view of the same.

As shown in FIG. 2, when the putting surface 4 is positioned perpendicular to the horizontal plane, the bar 7 inclines at an angle of 45 degrees and, as shown in FIG. 4, is just over the rib 6 in an aligned relation. The bar 7 and the rib 6 are formed on their respective upper surfaces with longitudinal centerlines 9 and 10, respectively.

As viewed from above as in FIG. 4, the horizontal bar 8 extends obliquely from the top end of the inclined bar 7 to a point right over one side end of the vertical wall 2. FIG. 4 shows a putter for a right-hander. For a left-handed golfer, the horizontal bar 8 is mounted so as to extend in the opposite direction. In either case, the shaft 11 is connected to the outer end of the bar 8.

Figure 5:
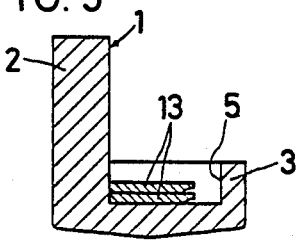
FIG. 5 is a partial vertical sectional view of the same.
Figure 6:
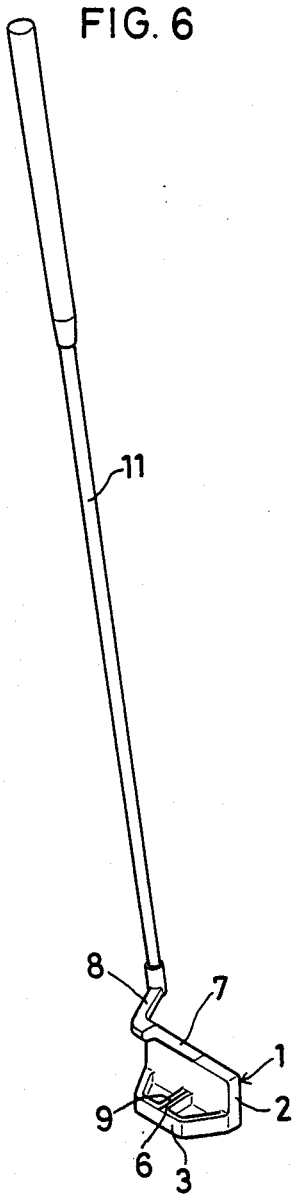
FIG. 6 is a perspective view of the same.
Figure 7:
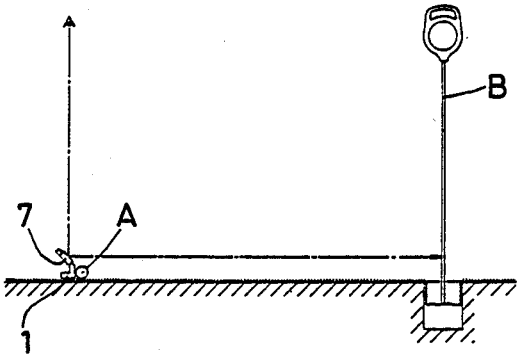
FIG. 7 is a schematic view showing how the putter is used.

The inclination of 45 degrees of the bar 7 allows a golfer to see a hole marker B or a pole through a mirror 12 detachably mounted on the bar 7 by sticking, fitting, or by use of a magnet, as shown in FIG. 6. The putter can be easily oriented so that the longitudinal axis of the bar 7 will be aligned with the longitudinal axis of the hole marker B or the pole reflected in the mirror 12. Thus the putting face 4 can be accurately directed at the hole and thus the ball can be putted in the right direction. Weights 13 may be fixedly mounted in the recesses 5 by means of adhesive or magnets to adjust the weight and balance of the head 1, as shown in FIGS. 4 and 5.

The putter is held by the grip of the shaft 11 and swung to meet the ball at its putting surface 4. The golfer can keep the putter head 1 from inclining sideways during a swing by holding the putter so as to position the bar 7 right over the rib 6. Further, in order to adjust the relative position between the bar 7 and the rib 6, he has to take such a posture as to see the putter head right under. This happens to be an ideal putting form. Before swinging, the direction in which the putter is swung is adjusted so that the bar 7 will be longitudinally trained on the hole. Thus, the putter will be swung in the right direction.

Owing to the fact that the shaft mounting bar is mounted sideways, it does not obstruct the view of the inclined bar when aligning the latter with the direction of the hole.

What is claimed is:

1. A golf putter comprising:

a head having a transversely extending vertical wall having first and second ends and a base attached to and projecting rearwardly from the back of said vertical wall at a lower portion thereof, a front surface of said vertical wall defining a putting surface, and said vertical wall and said base jointly defining a substantially L-shaped section;

an inclined bar having an upper and a lower end, said lower end of said inclined bar being attached to the top center of said vertical wall, said inclined bar extending rearwardly, upwardly, and obliquely, and said inclined bar being substantially perpendicular to the transverse axis of said vertical wall;

a shaft mounting bar having a first and a second end, said first end of said shaft mounting bar being attached to said upper end of said inclined bar, and said shaft mounting bar extending forwardly toward one of said first and second ends of said vertical wall;

a central rib attached to and extending rearwardly from the bottom center of said vertical wall, and said central rib being spaced below and vertically aligned with said inclined bar; and a vertically extending shaft attached to said second end of said shaft mounting bar.

2. A golf putter as in claim 1, wherein said base has a pair of recesses defined in an upper surface thereof, and said central rib is disposed between said recesses.

3. A golf putter as in claim 1, further comprising a mirror detachably mounted on a front surface of said inclined bar.

* * * * *